United States Patent [19]

Koepke et al.

[11] 4,365,536

[45] Dec. 28, 1982

[54] SLIDING ACTUATOR MEMBRANE SWITCH FOR ORGAN KEYBOARD

[75] Inventors: Donald B. Koepke, Leyden Township, Cook County; Martin C. Reed, Lake County, both of Ill.

[73] Assignee: Whirlpool Corporation, Benton Harbor, Mich.

[21] Appl. No.: 201,173

[22] Filed: Oct. 27, 1980

[51] Int. Cl.[3] ..... G10C 3/12

[52] U.S. Cl. ..... 84/433; 84/440; 84/DIG. 7

[58] Field of Search ..... 84/433–437, 84/DIG. 7, 1.01, 423, 439, 440; 200/5 E, 159 B

[56] References Cited

U.S. PATENT DOCUMENTS

| | | | |
|---|---|---|---|
| 1,840,712 | 1/1932 | Grant | 84/433 X |
| 3,342,967 | 9/1967 | Brand et al. | 200/159 B |
| 3,657,460 | 4/1972 | Cutler | 84/1.01 |
| 3,769,869 | 11/1973 | Nelson, Jr. | 84/1.01 |
| 3,909,564 | 9/1975 | Scheingold et al. | 200/5 E |
| 4,186,638 | 2/1980 | Fijima | 84/1.01 |

*Primary Examiner*—Richard A. Wintercorn
*Assistant Examiner*—Benjamin R. Fuller
*Attorney, Agent, or Firm*—Wegner, McCord, Wood & Dalton

[57] ABSTRACT

An organ key assembly having a loosely mounted switch actuator providing self-aligning movement of the actuator relative to the switch. The switch, in the illustrated embodiment, is a membrane switch. The actuator is arranged to slide across the switch in effecting the operation thereof. The actuator is associated with the key in such a manner as to permit the key to be moved from an undepressed, normal position to the fully depressed position, with a substantially constant force. The actuator defines a novel configuration for providing the self-aligning function and switch wiping operation. In the illustrated embodiment, the switch is provided as a portion of a printed circuit board. A support structure is provided for preventing deformation of the printed circuit board by the actuator biasing forces.

27 Claims, 8 Drawing Figures

FIG. 1
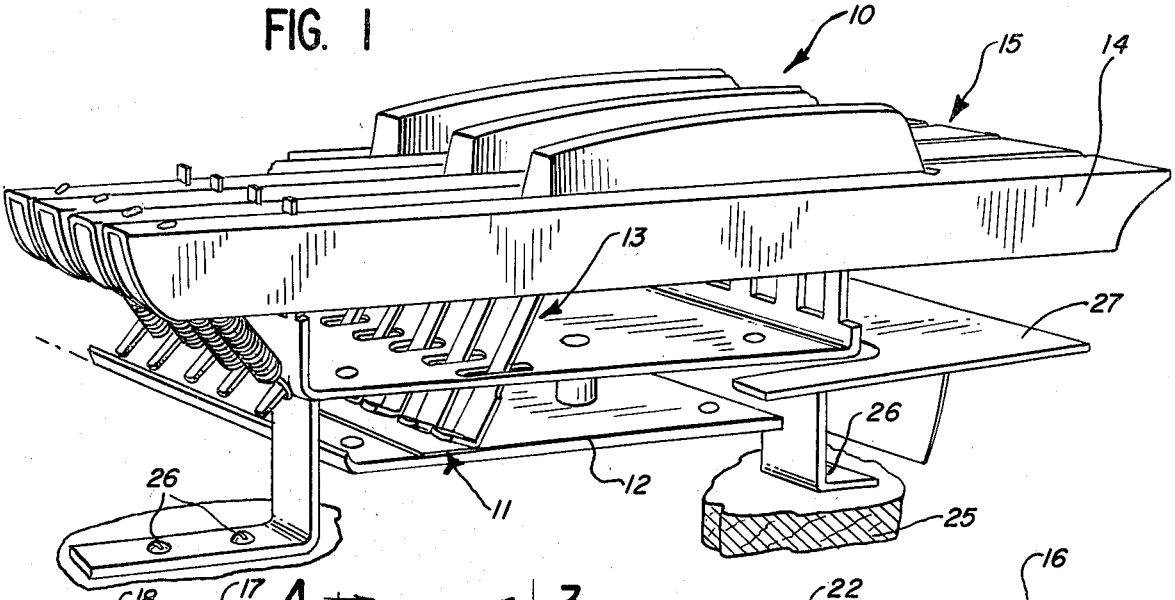
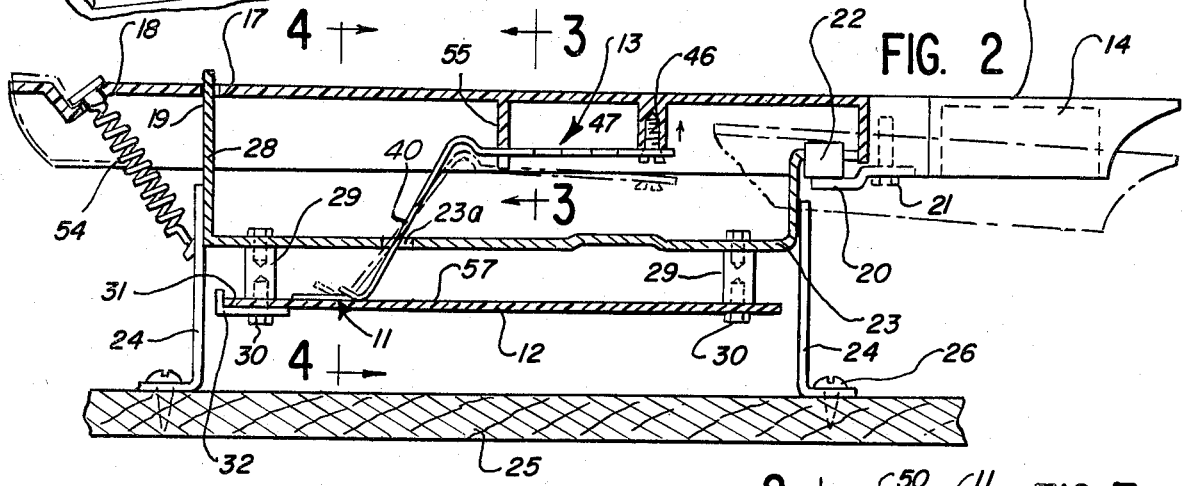
FIG. 2
FIG. 3
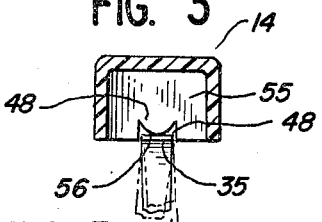
FIG. 4
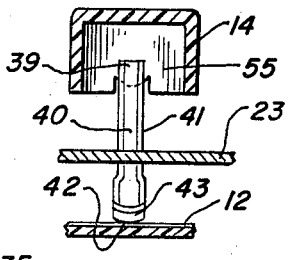
FIG. 5
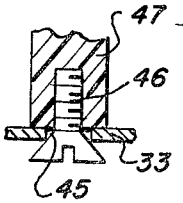
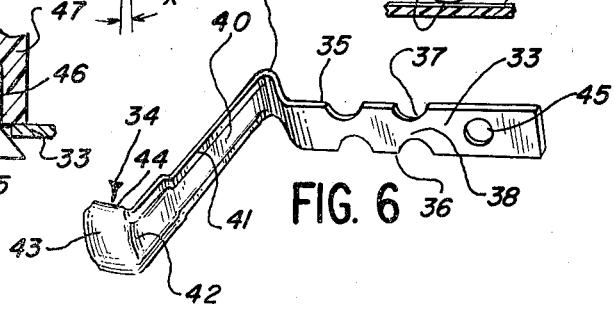
FIG. 6
8
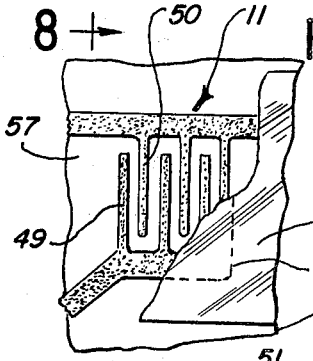
FIG. 7
8
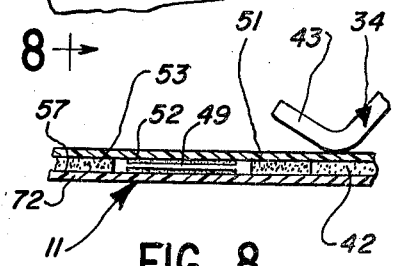
FIG. 8

SLIDING ACTUATOR MEMBRANE SWITCH FOR ORGAN KEYBOARD

BACKGROUND OF THE INVENTION

1. Field of the Invention

This invention relates to electronic musical instruments, such as organs, and more specifically, to a key switch assembly for use therein.

2. Description of the Background Art

In U.S. Pat. No. 3,342,967 of John R. Brand et al, a switch construction for use in an electronic musical instrument, such as an organ, is shown to include a switch body having divergent and self-biasing leaf spring members terminating in their free ends in a bifurcated contact. The contacts ride on the surface of a printed circuit board between selected conductive areas so as to cause a connection to be made between the bifurcated contacts. The leaf spring is caused to be resilient so as to avoid the necessity for additional biasing means in the device. The switch is arranged to develop a feel to the fingertip of the operator indicative of the switch position and the contact action.

Stanley Cutler, in U.S. Pat. No. 3,657,460, shows a keyboard switching assembly having a row of resilient switch members connected to a loudspeaker apparatus and positioned to be individually deflected upwardly against the contact assembly. The contact assembly includes a circuit board having conductive pads above the switch members. The switch members are actuated by the depression of a key to cause the upward deflection of the switch member against a portion of a conductive elastic strip normally spaced from an associated conductive pad.

In U.S. Pat. No. 3,769,869, Carl S. Nelson, Jr. discloses an electronic instrument switch which includes a cylindrical wire connected to a tone generator and a strip of conductive elastic material deflectible against the wire to have variable contact therewith. A lubricant is provided to permit the elastic material to spread smoothly outwardly under the pressure. An insulator strip is secured to the elastic conductive strip and a second elastic conductive strip is fastened to the insulator strip and grounded to shield the first conductive strip.

William S. Scheingold et al, in U.S. Pat. No. 3,909,564, show a keyboard assembly wherein a key acts on a spring member provided with a sliding portion movable to cause closing of contacts deposited on a flat flexible cable.

Masakatu Iijima shows, in U.S. Pat. No. 4,186,638, a keyboard device wherein a printed circuit board is provided with pairs of stationary contacts and a common movable contact made of rubber for connecting each pair of stationary contacts. The movable contact member is placed on the printed substrate and holding members provided on a keyboard frame restrict lateral expansion thereof when the movable contact member is brought into contact with the stationary contacts by depression of the keyboard keys.

The switching devices of the cited art present a number of problems such as the requirement of maintaining high accuracy and low tolerances in the assembly. This requirement results in relatively high cost of the assembly. Another problem in the use of such switching devices in keyboard electrical instruments was in the variation in the key resistance to movement as the key is depressed from the undepressed to the fully depressed position in playing the musical instrument. It is highly desirable in such instruments to provide for a key depression with minimum variation in the force required to depress the key over the range of movement from the undepressed to the fully depressed condition. It is further desirable to prevent discontinuities in the resistance force over the range of movement of the key.

SUMMARY OF THE INVENTION

The present invention comprehends an improved organ key assembly which is extremely simple and economical of construction, while yet providing improved functioning and avoiding the problems of the above-discussed prior art structures.

More specifically, the invention comprehends the provision of an organ key assembly having a key, means for pivotally mounting the key, means for pivotally biasing the key to a normal position, and a membrane switch mounted adjacent the key. An improved actuator for operating the switch as an incident of pivotal depression of the key from the normal undepressed position is provided including a resiliently deflectible element having an end portion loosely secured to the key, a switch actuating portion slidably engaging the membrane switch and a guide portion intermediate the end portion and switch actuating portion, and force transfer means on the key for movably engaging the actuator guide portion to adjustably urge the switch actuating portion against the switch to operate the switch as an incident of the key depression with the loose securement of the actuator to the key and the movable engagement of the force transfer means with the actuator guide portion permitting free alignment of the switch actuating portion with the switch during such operation.

The invention further provides an improved actuator structure comprising a resiliently deflectible strip having a connecting portion having low resistance to torsion for improved facilitated free alignment of the switch actuating portion with the switch during the switching operation.

In the illustrated embodiment, the deflectible element comprises a spring metal strip which is further provided with a flat first connecting portion extending between the end portion and the guide portion substantially parallel to the key, a bending portion between the guide portion and the switch engaging portion, and a second flat connecting portion extending between the bending portion and the switch engaging portion away from the key to space the switch engaging portion substantially from the key.

The organ key assembly may include a plurality of keys with a plurality of improved actuator means associated one each with the respective keys. The switch means in the illustrated embodiment comprises a plurality of membrane switches on a printed circuit board and the switch actuating portion slidably engages the printed circuit board at the switch means. The actuating portion of the actuator slidably engages the printed circuit board in moving across the switches for improved facilitated switching action.

The invention further comprehends providing support means for rigidly supporting the printed circuit board against deformation from the biasing forces continuously applied thereagainst through the actuators.

In broad aspect, the actuating means of the present invention comprises means slidably engaging the membrane switch for operating the same and means operatively associating the actuator means with the musical instrument key to cause self-adjusting controlled sliding movement of the actuator means across the switch as an incident of pivotal movement of the key. The structure is arranged to have effectively minimum variation in the resistance to pivotal movement of the key over the range of movement thereof in the playing of the instrument. In the illustrated embodiment, the resistance to pivotal depression increases gradually by approximately thirty-three percent as the key is depressed.

Thus, the organ key assembly structure of the present invention defines novel and simple means for providing improved keyed operation of membrane switches in electronic devices, such as electronic organs.

BRIEF DESCRIPTION OF THE DRAWING

Other features and advantages of the invention will be apparent from the following description taken in connection with the accompanying drawing wherein:

FIG. 1 is a fragmentary perspective view of an organ key assembly structure embodying the invention;

FIG. 2 is a fragmentary vertical section taken through one of the keys of the assembly;

FIG. 3 is a fragmentary vertical transverse section taken substantially along the line 3—3 of FIG. 2;

FIG. 4 is a fragmentary transverse section taken substantially along the line 4—4 of FIG. 2;

FIG. 5 is a fragmentary vertical section illustrating the loose connection of the end of the actuator element to the key;

FIG. 6 is a perspective view of the actuator element;

FIG. 7 is a fragmentary plan view with a portion of the overlay broken away of a portion of the printed circuit board defining one of the switches of the assembly; and FIG. 8 is a fragmentary vertical section taken substantially along the line 8—8 of FIG. 7 illustrating further the association of the actuating end portion of the actuator and the switch means of the assembly in the undepressed position of the key.

DESCRIPTION OF THE PREFERRED EMBODIMENT

In the illustrative embodiment of the invention as disclosed in the drawing, a musical instrument structure generally designated 10 is shown to comprise a portion of an electronic musical instrument, such as an electronic organ. The present invention is concerned with the actuation of the electronic switches 11 of the assembly which are carried on a printed circuit board 12. Operation of the switches is effected by means of an improved actuator generally designated 13 which operates the switches as an incident of the pivotal depression of the respective keys 14 of the instrument keyboard 15.

As shown in FIG. 1, the keyboard 15 comprises a conventional keyboard having a plurality of keys 14 in side-by-side relationship. A plurality of the switches 11 are provided on the printed circuit board 12 also in side-by-side relationship in correspondence with the respective keys 14. As shown, a corresponding plurality of actuators 13 is provided associated one each with the respective keys for operating the corresponding switch. Each of the actuators is similar. The structural arrangement of each key and its associated actuator for engaging the associated corresponding switch is illustrated in FIGS. 2–8, it being understood that the structure 10 defines a plurality of such structures along the keyboard 15.

More specifically, as shown in FIG. 2, key 14 defines a fingertip engaging portion 16 at one end, an intermediate pivot portion 17, and a biasing spring connecting portion 18 at the opposite end. As shown, spring 18 tends to bias the key in a counterclockwise direction about a pivot 19 on which the pivot portion 17 of the key is pivotally mounted. The biasing action thusly urges the fingertip portion 16 upwardly. The upward movement of key portion 16 is limited by the engagement of a tab 20 secured to the key by suitable means, such as screw 21, engaging a resilient stop element 22 carried by a rigid support plate 23. The support plate, in turn, is carried by a pair of standing legs 24 and may be secured to a base 25 by suitable means, such as screws 26. A protective apron 27 may be provided, as shown in FIG. 1, to underlie the front portion 16 of the keys.

As further illustrated in FIG. 2, pivot 19 is defined by an upstanding rear wall 28 of the support plate 23. The printed circuit board 12 is secured subjacent the plate 23 by means of a plurality of support posts 29 and suitable securing means, such as screws 30. As further shown in FIG. 2, the rear portion 31 of the printed circuit board is supported by a rigid flange support 32 secured to the post 29 to provide a rigid support of the printed circuit board adjacent switches 11.

As indicated above, the present invention comprehends an improved actuator 13 for operating switches 11 as an incident of pivotal movement of the keys 14 in playing the instrument. The actuator is illustrated in FIG. 6 as comprising a formed strip of suitable material, such as resilient metal. In the illustrated embodiment, the actuator is formed of stainless steel. As shown in FIG. 6, the actuator includes an end portion 33, a switch actuating portion 34, and a guide portion 35.

Intermediate end portion 33 and guide portion 35, the actuator is provided with a first connecting portion 36 provided with a plurality of notches 37 in transversely aligned relationship so as to define a midportion 38 of the actuator, which is relatively low in torsional resistance.

Intermediate guide portion 35 and actuating portion 34 of the actuator, the actuator is provided with an arcuate stress relief portion 39 and a second connecting portion 40 extending between the arcuate portion 39 and the actuating end portion 34, as shown in FIG. 6.

The second connecting portion 40 is preferably relatively stiff and is provided with side flanges 41 for this purpose.

Actuating end portion 34 defines the switch actuating means and, as shown, includes a lowermost slide surface 42 which, by way of example, may be segmentally cylindrical, and a turned end portion 43 which may be provided with side flanges 44 for rigidification thereof.

End portion 33 of the actuator is provided with a through opening 45. As shown in FIG. 2, a screw 46 is extended through the opening 45 into a boss 47 on the underside of key 14 to secure the end 33 of the actuator to the key.

The key is further provided with a depending flange 55 having an arcuate force transfer surface 56 engaging the guide portion 35 of the actuator, as shown in FIG. 3. Surface 56 is recessed within the bottom edge of flange 55 to define a pair of side guide surfaces 48 at opposite sides of the actuator guide portion 35 to direct the actuator generally parallel to the longitudinal extent of key 14.

As shown in FIG. 7, switch 11 is defined by interleaved contacts 49 and 50 on the printed circuit board. A deflectible overlay strip 51 formed of a suitable material, such as a synthetic resin, overlies the contacts 49, 50 and is provided in overlying relationship with each set of these contacts with a layer of conductive material, such as conductive ink 52. The overlay strip 51 may be secured to the upper surface 57 of the printed circuit board by a suitable adhesive layer 53.

As shown in FIGS. 2 and 8, in the normal undepressed position of key 14, the actuator portion 40 extends downwardly through an open portion 23*a* of the mounting plate 23 with slide surface 42 of the actuating portion 34 of actuator 13 engaging the top surface of the overlay strip 51 adjacent the switch 11. When portion 16 of key 14 is depressed, actuator 13 is correspondingly urged downwardly with the actuating portion 34 thereof being slid across the switch overlay strip 51 from the full position of FIG. 2 to the broken line position of FIG. 2. In the broken line position, the actuating portion urges the conductive ink area 52 on the overlay strip 51 into electrical contacting association with the contacts 49 and 50 of switch 11 so as to close the switch between the contacts 49 and 50.

As shown in FIG. 2, key 14 is biased in a counterclockwise direction by a coil spring 54 connected between key connection portion 18 and leg 24. The resistance to the depression of key portion 16 in the playing of the musical instrument, produced by spring 54 and the spring force produced by actuator 13, is relatively uniform over the range of movement of the key from the undepressed, full line position of FIG. 2 to the fully depressed broken line position thereof. In one illustrative arrangement of the organ structure 10, the parameters of the structure were selected so as to provide a resistance to such key depression increasing gradually to approximately one and one-third times the resistance to pivotal depression at the undepressed position, and illustratively varying from approximately 3.4 oz. to approximately 4.5 oz. in the depression of the key from the undepressed to fully depressed positions of FIG. 2. Further, in the novel arrangement of the structure 10, the resistance to depression of the key increases smoothly as the key is depressed so as to provide desirable "touch" or "feel" to the player of the instrument.

In one illustrative embodiment of the structure 10, the key had a length of approximately 9" from the pivot 17 to the end of the key at the fingertip portion 16, and a length of 0.8" from the pivot 17 to the spring connecting portion 18. The actuator slide surface 42 had a sliding movement of approximately ¼" being spaced from the vertical plane of pivot 17 approximately 1.68" in the undepressed condition of the key and approximately 1.45" in the depressed condition. The spring actuator had a resistance to key depression varying from 7 oz. to 11 oz. and the return spring 54 had a tension force varying from 27 oz. to 30 oz. with movement of the key from the undepressed to the depressed position. The spring 54 extended at an angle of approximately 50° to the horizontal.

In the illustrated embodiment, switches 11 comprise single pole, single throw switches. As will be obvious to those skilled in the art, other suitable switch configurations may be utilized commensurate with the desired circuit board circuitry, within the scope of the invention.

As seen in FIG. 5, opening 45 has a diameter larger than the shank of the screw 46 and bottoms in boss 47 such that the screw loosely holds end portion 33 of the actuator, so as to permit some longitudinal adjustment of its position relative to the key.

Further as shown in FIG. 3, the actuator may have adjustable movement controlled by the arcuate force transfer surface 56 and the side guide surfaces 48 on flange 55. Thus, the actuator 13 can self adjust such that slide surface 42 maintains an accurate line engagement with the surface of overlay strip 51 as the actuator moves from the full line position of FIG. 2 to the switch closing, broken line position thereof. This self alignment of the slide surface 42 takes place upon initial assembly of the keys 14 onto the keyboard assembly 15 and as needed during actuation of the individual keys. It has been found that such improved maintained line contact assures a positive actuation of the switches while yet permitting the desirable, effectively minimum gradual force increase providing the desirable feel to the player of the instrument, as discussed above.

While spring 54 has a strength greater than the biasing force of actuator 13 against the printed circuit board 12, the actuator provides a constant pressure against the printed circuit board. Support 32 effectively precludes deformation of the printed circuit board from such pressure and further assures the desired substantially constant resistance key action.

Still further, the low torsion portions 38 of the actuator permit a small amount of twisting or torsional movement of the actuator guide portion 35 to accommodate it to the arcuate surface 56 in maintaining the desired line contact of the slide surface 42 with the printed circuit board overlay 51.

The cost of the improved structure 10 is effectively minimized by providing the self-aligning functioning of the actuator by effectively reducing the necessity for high tolerance accuracy in the construction of the elements of the structure. Further, the structure is extremely simple and economical in the use of a small number of easily manufactured parts while yet the structure provides an improved feel to the player of the instrument simulating the feel of the conventional pipe organ.

The foregoing disclosure of specific embodiments is illustrative of the broad inventive concepts comprehended by the invention.

Having described the invention, the embodiments of the invention in which an exclusive property or privilege is claimed are defined as follows:

1. In an organ key assembly having a key, means for pivotally mounting the key, means for pivotally biasing the key to a normal position, and a membrane switch mounted adjacent the key, an improved actuator means for operating the switch as an incident of pivotal depression of the key from the normal position, said actuator means comprising:

a resiliently deflectible actuator having an end portion loosely secured to the key, a switch actuating portion slidably engaging the membrane switch, and a guide portion intermediate said end portion and switch actuating portion; and force transfer means on the key for movably engaging the actuator guide portion to adjustably urge the switch actuating portion against the switch to operate the switch as an incident of the key depression, wherein the loose securement of the actuator to the key and the movable engagement of the force transfer means with the actuator guide portion permit self alignment of the switch actuating portion with the switch.

2. The organ key assembly of claim 1 wherein said force transfer means defines an arcuate rocker surface engaging the actuator guide portion.

3. The organ key assembly of claim 1 wherein said actuator defines an arcuate stress relief portion intermediate said guide portion and said switch engaging portion.

4. The organ key assembly of claim 1 wherein said actuator defines an arcuate stress relief portion intermediate said guide portion and said switch engaging portion, and an elongate connecting portion between said stress relief portion and said switch engaging portion, said connecting portion having turned edge flanges to define a rigid connection between said stress relief portion and said switch engaging portion.

5. The organ key assembly of claim 1 wherein said switch defines a planar actuation surface and said switch engaging portion defines a segmentally cylindrical slide surface having line contact with said switch actuation surface during movement of the switch actuating portion of the actuator in operating the switch.

6. In an organ key assembly having a key, means for pivotally mounting the key, means for pivotally biasing the key to a normal position, and a membrane switch mounted adjacent the key, an improved actuator means for operating the switch as an incident of pivotal depression of the key from the normal position, said actuator means comprising:

a resiliently deflectible strip actuator having an end portion secured to the key, a switch actuating portion slidably engaging the membrane switch, a guide portion intermediate said end portion and switch actuating portion, and a connecting portion having a low resistance to torsion; and force transfer means on the key for movably engaging the actuator guide portion to adjustably urge the switch actuating portion against the switch to operate the switch as an incident of the key depression, wherein the low resistance to torsion of the connecting portion and the movable engagement of the force transfer means with the actuator guide portion cooperatively permit self alignment of the switch actuating portion with the switch during such operation.

7. The organ key assembly of claim 6 wherein said connecting portion comprises a flat portion provided with notched edges.

8. The organ key assembly of claim 6 wherein said connecting portion comprises a flat portion provided with notched edges, the notches being aligned transversely of the flat portion.

9. The organ key assembly of claim 6 wherein said connecting portion comprises a flat portion provided with notched edges, the notches being aligned transversely of the flat portion, with the portion of the connecting portion between the aligned notches being approximately one-third the full width of the connecting portion.

10. The organ key assembly of claim 6 wherein said connecting portion is disposed intermediate said end portion and said guide portion.

11. In an organ key assembly having a key, means for pivotally mounting the key, means for pivotally biasing the key to a normal position, and a membrane switch mounted adjacent the key, an improved actuator means for operating the switch as an incident of pivotal depression of the key from the normal position, said actuator means comprising:

a spring metal strip actuator having an end portion secured to the key, a switch actuating portion slidably engaging the membrane switch, a guide portion intermediate said end portion and switch actuating portion, a first flat connecting portion extending between said end portion and said guide portion substantially parallel to said key, a bending portion between said guide portion and said switch engaging portion, and a second flat connecting portion extending between said bending portion and said switch engaging portion away from the key to space said switch engaging portion substantially from said key; and force transfer means on the key for engaging the actuator guide portion to urge the switch actuating portion against the switch to operate the switch as an incident of the key depression.

12. The organ key assembly of claim 11 wherein said first connecting portion is provided with a torsionally weak portion permitting limited torsional movement thereof to align the switch actuating portion with the switch.

13. The organ key assembly of claim 11 wherein said second connecting portion is provided with stiffening means for causing the second connecting portion to extend substantially undeflectibly between said bending portion and said switch engaging portion.

14. The organ key assembly of claim 11 wherein said switch engaging portion has a width substantially greater than said second connecting portion.

15. The organ key assembly of claim 11 wherein said switch engaging portion has a width substantially greater than said second connecting portion and is provided with turned edge flanges.

16. In an organ key assembly having a plurality of keys, means for pivotally mounting the keys to define a keyboard, means for pivotally biasing the keys to a normal position, and a printed circuit board provided with a plurality of membrane switches disposed one each adjacent the respective keys, improved actuator means associated one each with the respective keys for operating the associated switches as an incident of pivotal depression of the keys from the normal position, each said actuator means comprising:

a spring metal strip actuator having an end portion secured to the key, a switch actuating portion slidably engaging the printed circuit board at said membrane switch, a guide portion intermediate said end portion and switch actuating portion, a first connecting portion extending between said end portion and said guide portion substantially parallel to said key, a bending portion between said guide portion and said switch engaging portion, and a second connecting portion extending between said bending portion and said switch engaging portion away from the key to dispose said switch engaging portion in sliding engagement with said printed circuit board; and force transfer means on the key for engaging the actuator guide portion to urge the switch actuating portion against the switch to operate the switch as an incident of the key depression.

17. The organ key assembly of claim 16 wherein a rigid support is provided for supporting the printed circuit board adjacent said switches for maintaining the switches in coplanar relationship.

18. The organ key assembly of claim 16 further including a rigid mounting means for carrying the printed circuit board and provided with an open portion, said actuators extending through said open portion.

19. The organ key assembly of claim 16 further including a rigid mounting means for carrying the printed circuit board and provided with an open portion, said second connecting portion of the actuators extending through said open portion.

20. The organ key assembly of claim 16 wherein a rigid support is provided for supporting said pivot means and stop means are provided on the rigid support for limiting the printed depression of the keys to limit the sliding movement of the actuator actuating portion on the printed circuit board.

21. The organ key assembly of claim 16 wherein a rigid support is provided for supporting said pivot means and said means for pivotally biasing the keys comprises a plurality of springs connected one each between the respective keys and said rigid support.

22. In an organ key assembly having a key, means for pivotally mounting the key, means for pivotally biasing the key to a normal position, and a membrane switch mounted adjacent the key, an improved means for actuating said switch comprising:

actuating means slidably engaging the membrane switch for operating the switch; and means operatively associating the actuating means with the key for causing self-adjusting controlled sliding movement of the actuator means across the switch as an incident of pivotal movement of the key.

23. The organ key assembly of claim 22 wherein said means operatively associating the actuating means with the key includes resilient connecting means causing the actuating means to be resiliently urged against said membrane switch.

24. The organ key assembly of claim 22 wherein said means operatively associating the actuating means with the key comprises means for causing the resistance to pivotal depression of the key to have only a small variation over the range of pivotal movement thereof in operating said switch.

25. The organ key assembly of claim 24 wherein said resistance is in the range of approximately 3.4 to 4.5 ounces.

26. The organ key assembly of claim 24 wherein said means operatively associating the actuating means with the key comprises means for causing the resistance to pivotal depression of the key from an undepressed position to a fully depressed position to increase gradually.

27. The organ key assembly of claim 24 wherein said means operatively associating the actuating means with the key comprises means for causing the resistance to pivotal depression of the key from an undepressed position to a fully depressed position to increase gradually to approximately one and one-third times the resistance to pivotal depression at the undepressed position.

* * * * *